US011866933B2

(12) United States Patent
Sandler

(10) Patent No.: US 11,866,933 B2
(45) **Date of Patent: *Jan. 9, 2024**

(54) WATERPROOFING AND SAFETY-INCREASING PREFABRICATED BUILDING FRAMING SYSTEM AND METHOD

(71) Applicant: Pillar Patent Holdings LLC, Alexandria, VA (US)

(72) Inventor: Bryan David Sandler, Fairfax, VA (US)

(73) Assignee: Plllar Patent Holdings LLC, Alexandria, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/810,086

(22) Filed: Jun. 30, 2022

(65) Prior Publication Data

US 2022/0333373 A1 Oct. 20, 2022

Related U.S. Application Data

(63) Continuation of application No. 17/248,122, filed on Jan. 11, 2021, now Pat. No. 11,408,168.

(51) Int. Cl.

| | |
|---|---|
| ***E04B 2/60*** | (2006.01) |
| ***E04B 2/78*** | (2006.01) |
| ***E04B 2/76*** | (2006.01) |

(Continued)

(52) U.S. Cl.

CPC ..... *E04B 2/60* (2013.01); *E04B 1/2403* (2013.01); *E04B 2/7457* (2013.01); *E04B 2/767* (2013.01);

(Continued)

(58) Field of Classification Search

CPC .. E04B 1/2403; E04B 2001/2448; E04B 2/60; E04B 2/7412; E04B 2/7453;

(Continued)

(56) References Cited

U.S. PATENT DOCUMENTS 5,218,793 A * 6/1993 Ball ..... E04F 13/0864 52/412
5,315,804 A * 5/1994 Attalla ..... E04C 3/06 52/362

(Continued)

FOREIGN PATENT DOCUMENTS

CN 106567476 A * 4/2017
DE 10232855 A1 * 2/2004 ..... E04B 2/7412

(Continued)

*Primary Examiner* — Jessie T Fonseca

(74) *Attorney, Agent, or Firm* — Squire Patent Consulting & IP Law LLC; Brendan E. Squire

(57) ABSTRACT

A waterproof and safety framing system is disclosed. The framing system includes a building defining an opening, a wall panel, and a framing assembly. The framing assembly includes receiver and a bottom track. The receiver is installed along an edge of the opening, with the receiver including a receiver bottom wall that defines a receiver ridge extending along a length of the receiver. The bottom track is attached to an edge of the wall panel and including a track bottom wall that defines a track ridge, with the receiver and the bottom track matingly engaging such that the bottom track overlays the receiver and the receiver ridge and the track ridge are proximal one another. The framing assembly is structured to prevent the wall panel from passing through the opening in a first direction.

13 Claims, 4 Drawing Sheets

(51) Int. Cl.
*E04B 2/74* (2006.01)
*E04B 1/24* (2006.01)
*E04C 3/04* (2006.01)

(52) U.S. Cl.
CPC ..... *E04B 2/789* (2013.01); *E04B 2001/2448* (2013.01); *E04C 2003/0473* (2013.01)

(58) Field of Classification Search
CPC ..... E04B 2/7457; E04B 2/767; E04B 2/789; E04C 2003/0473
See application file for complete search history.

(56) References Cited

U.S. PATENT DOCUMENTS 7,788,878 B1 * 9/2010 diGirolamo ..... E04B 2/58 52/745.19
8,281,552 B2 * 10/2012 Pilz ..... E04B 1/943 52/846
10,563,399 B2 * 2/2020 Pilz ..... E04B 1/948
2005/0076600 A1 * 4/2005 Moody ..... E04B 2/7453 52/633
2007/0125026 A1 * 6/2007 Frobosilo ..... E04B 2/767 52/481.1
2009/0038764 A1 * 2/2009 Pilz ..... E04B 2/82 160/194
2009/0178363 A1 * 7/2009 Pilz ..... E04B 1/24 52/710
2009/0178369 A1 * 7/2009 Pilz ..... E04B 2/96 52/781.3
2012/0067000 A1 * 3/2012 Kiilunen ..... E04B 2/767 52/653.1
2013/0219815 A1 * 8/2013 Pilz ..... E04B 1/946 52/232
2018/0371748 A1 * 12/2018 Klein ..... B32B 9/046
2019/0316350 A1 * 10/2019 Pilz ..... E04B 2/7411

FOREIGN PATENT DOCUMENTS

DE 20221261 U1 * 9/2005 ..... E04B 2/7457
EP 0638758 A2 * 2/1995 ..... E04B 9/18
FR 2247597 A1 * 5/1975 ..... E04B 1/2403
KR 101778994 B1 * 9/2017
WO WO-03001003 A1 * 1/2003 ..... E04B 2/7412

* cited by examiner

WATERPROOFING AND SAFETY-INCREASING PREFABRICATED BUILDING FRAMING SYSTEM AND METHOD

CROSS-REFERENCE TO RELATED APPLICATION

This application claims the benefit of priority of U.S. provisional application Ser. No. 17/248,122 filed Jan. 11, 2021, the contents of which are herein incorporated by reference.

BACKGROUND OF THE INVENTION

The present invention relates to prefabricated exterior wall installations and, more particularly, to a system and method for providing a waterproofed and secure exterior wall panel installation from an interior of a building.

Prefabricated, structural cold-formed metal framing (CFMF) bearing walls are quickly becoming a popular construction system choice in large part due to this system being economical in comparison to other systems, such as reinforced concrete or structural steel. When installing prefabricated exterior wall panels from the interior of a building, in particular, in a slab-to-slab condition, there is no way to waterproof the installation without accessing the exterior of the building. This is particularly a challenge when the installation is not occurring on the ground level of the building.

With traditional installation methods of exterior prefabricated wall panels, gaps at the floor, head and edges of the installed panels allow for water infiltration prior to accessing the exterior of the building to install and air barrier. In addition, the installation of exterior panels from the interior of the building can create an unstable condition to where the exterior panels extend too far outbound of the building and fall to the ground, creating a safety hazard.

As can be seen, there is a need for a system and method for providing a waterproofed exterior wall panel installation from an interior of the building that ameliorates the aforementioned problems, including safety issues.

SUMMARY OF THE INVENTION

In one aspect of the present invention, a framing assembly, for installing a wall panel in an opening of a building, comprises: a receiver configured to be installed along an edge of the opening, the receiver including a receiver bottom wall that defines a receiver ridge extending along a length of the receiver; and a bottom track configured to be attached to an edge of the wall panel and including a track bottom wall that defines a track ridge, the receiver and the bottom track matingly engaging such that the bottom track overlays the receiver and the receiver ridge and the track ridge are proximal one another.

In another aspect of the present invention, a framing system comprises: a building defining an opening; a wall panel; and a framing assembly comprising: a receiver installed along an edge of the opening, the receiver including a receiver bottom wall that defines a receiver ridge extending along a length of the receiver; and a bottom track attached to an edge of the wall panel and including a track bottom wall that defines a track ridge, the receiver and the bottom track matingly engaging such that the bottom track overlays the receiver and the receiver ridge and the track ridge are proximal one another.

These and other features, aspects and advantages of the present invention will become better understood with reference to the following drawings, description and claims.

DETAILED DESCRIPTION OF THE INVENTION

Figure 1:
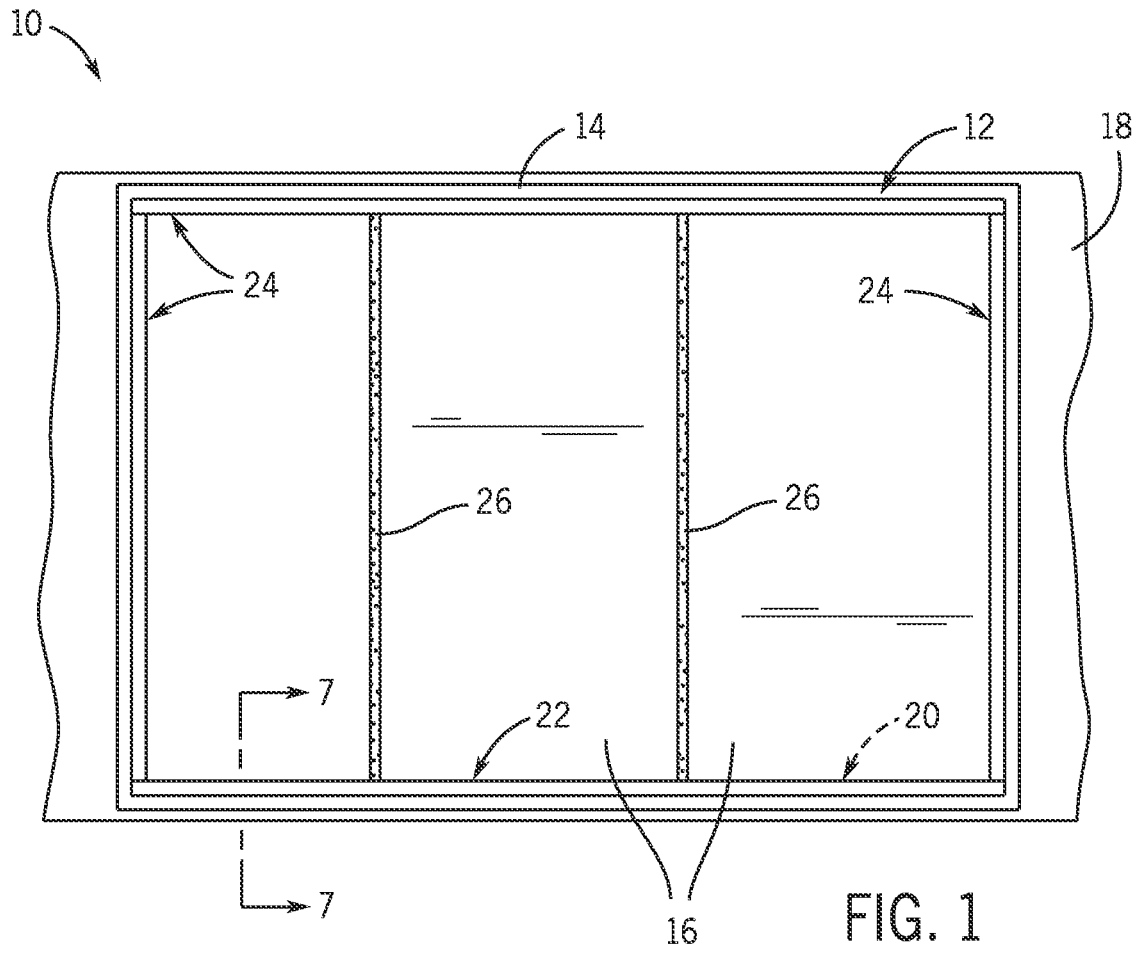
FIG. 1 is a front elevation view of an embodiment of the present invention, in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, one embodiment of the present invention is a framing assembly that prevents air and moisture infiltration into a building. The framing assembly includes a bottom track that attaches to a wall panel and a receiver that is installed into an opening in the building. The bottom track and receiver both include ridges that mate when the wall panel is installed in the building opening such that no moisture or air can pass between the bottom track and the receiver. Further provided in the embodiment described herein is structure that prevents the wall panel from falling through the building opening accidentally, increasing the safety for individuals at a job site.

Currently, in the installation of the drywall metal framing, there is an issue of water infiltration that prohibits the start of the drywall process. The invention will alleviate a significant amount of water infiltration when used with a prefabricated or field installed exterior wall. There are a number of manufacturers who currently prefabricate exterior slab-to-slab framing panels, but this still does not prevent water infiltration due to negative pressure at the base and terminations of the wall. In addition, the secondary benefit to the system and method described herein is the ability to prevent the exterior prefabricated panel from accidentally falling from the edge of the building during install as it will create a "frame" around the opening in which the exterior panel is to be installed.

In accordance with certain aspects of the present invention, three fabricated members are installed in a building opening. Two of the three fabricated members may be installed prior to an exterior panel being set in place and the third fabricated member being installed on the prefabricated exterior panel itself, rather than utilizing a customary bottom track. This unique configuration results in a watertight installation of the prefabricated exterior panel despite being installed from the interior of the building. In certain embodiments of the present invention, this result is achieved by utilizing a novel interlocking V-profile track and receiver with angle members fastened at terminations of the wall, which allows for the fabricated members to be waterproofed prior to the exterior panels being installed in the building opening. Thus, the installed assembly is watertight as soon as the exterior panels are installed, and a further benefit of the system discussed herein is that the fabricated members prevent the exterior panels from falling from the building while being installed. The following detailed description will make clear these benefits, and others not yet discussed, of the present invention. It should be understood, of course, that the structure described is exemplary and intended to illustrate core concepts of the present invention, and modifications to the design may be made without departing from the spirit and scope of the present invention as claimed.

Figure 2:
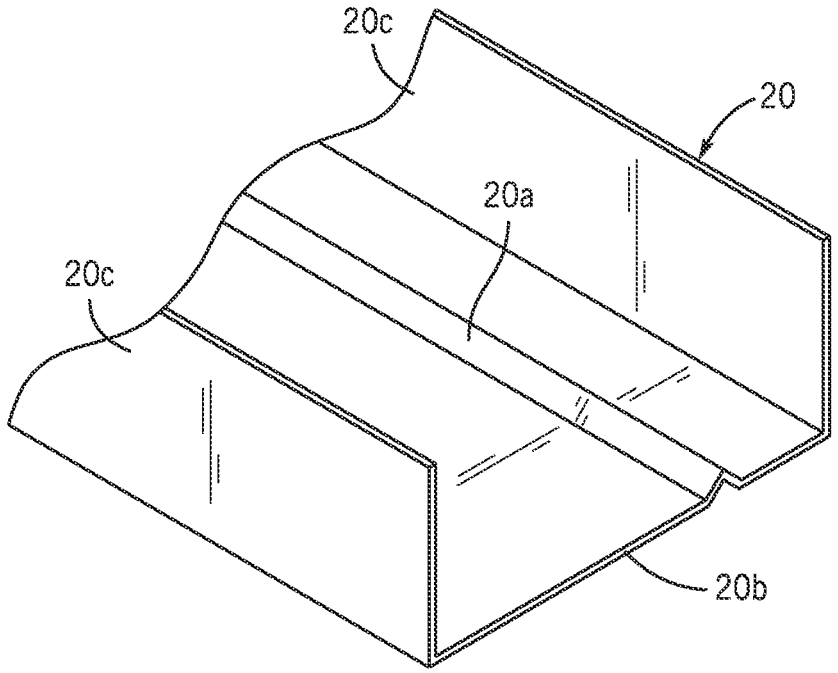
FIG. 2 is a detail perspective view of a bottom track of the embodiment of the present invention.
Figure 3:
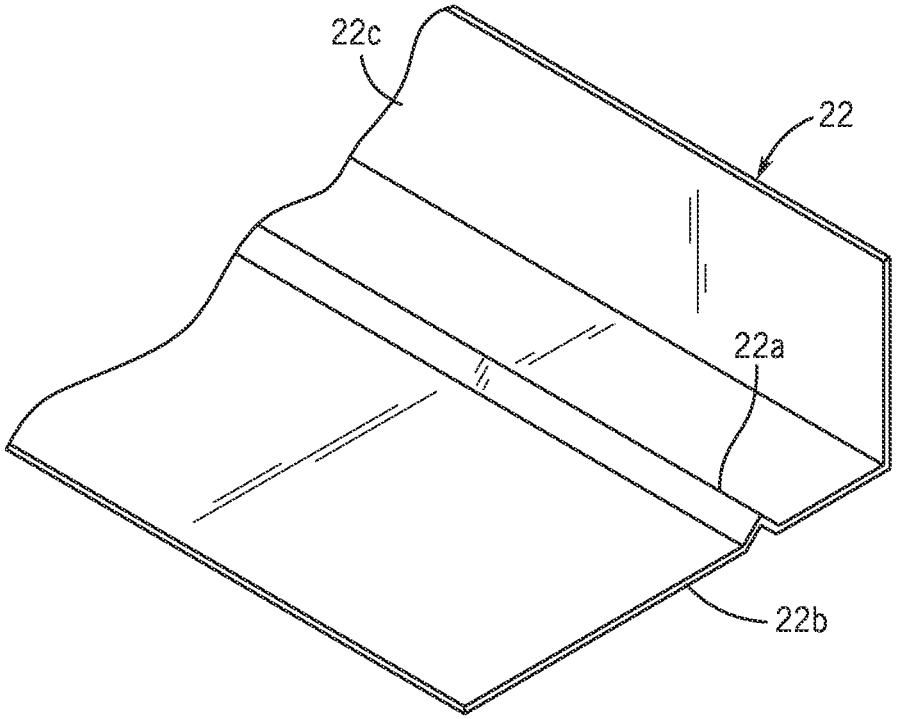
FIG. 3 is a detail perspective view of a receiver of the embodiment of the present invention.
Figure 4:
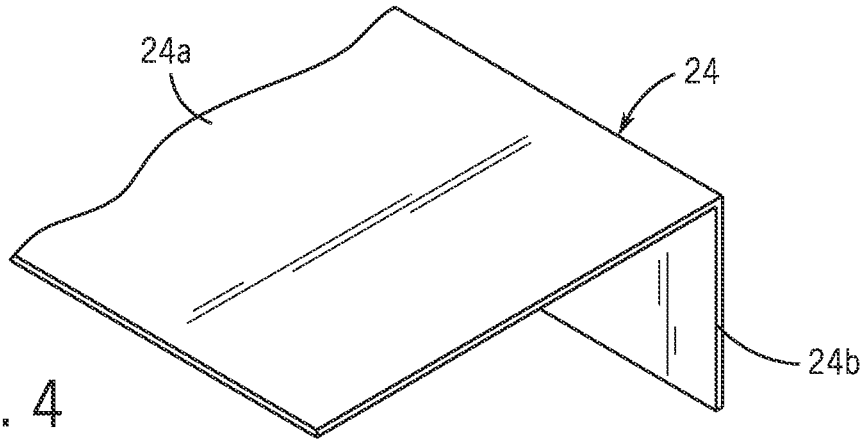
FIG. 4 is a detail perspective view of an angle member of the embodiment of the present invention.

Referring to FIGS. 1-7, a waterproof framing system 10 is disclosed. As part of this system 10, a framing assembly 12, an air/moisture barrier 14, and a wall panel 16 are provided. As shown in FIG. 1, the framing assembly 12, air/moisture barrier 14, and wall panel 16, in use, are installed in an opening of a building 18. In certain preferred embodiments of the present invention, the framing assembly 12 may include a bottom track 20, a receiver 22, substantially L-shaped angle members 24. The bottom track, as shown in FIG. 2, may include a track ridge 20*a* (for example, it may resemble an inverted V-shape and come to a point) extending along a length of the bottom track 20, a track bottom wall 20*b*, and two oppositely disposed track upper walls 20*c* extending upwardly from the bottom wall 20*b* and, in combination with the bottom wall 20*b*, define a channel. The receiver 22, as shown in FIG. 3, may include a receiver ridge 22*a* (for example, it may resemble an inverted V-shape and come to a point) extending along a length of the receiver 22, a receiver bottom wall 22*b*, and a receiver upper wall 22*c* extending from the receiver bottom wall 22*b*. The angle members 24, as shown in FIG. 4, may include a first wall 24*a* and a second wall 24*b*, with the first wall 24*a* having a greater width than a width of the second wall 24*b*. In use, the first wall 24*a* directly engages the opening. Finally, sealant 26 and sheathing 28 (such as gypsum sheathing) may be provided, as well, as part of the waterproof framing system 10.

Figure 7:
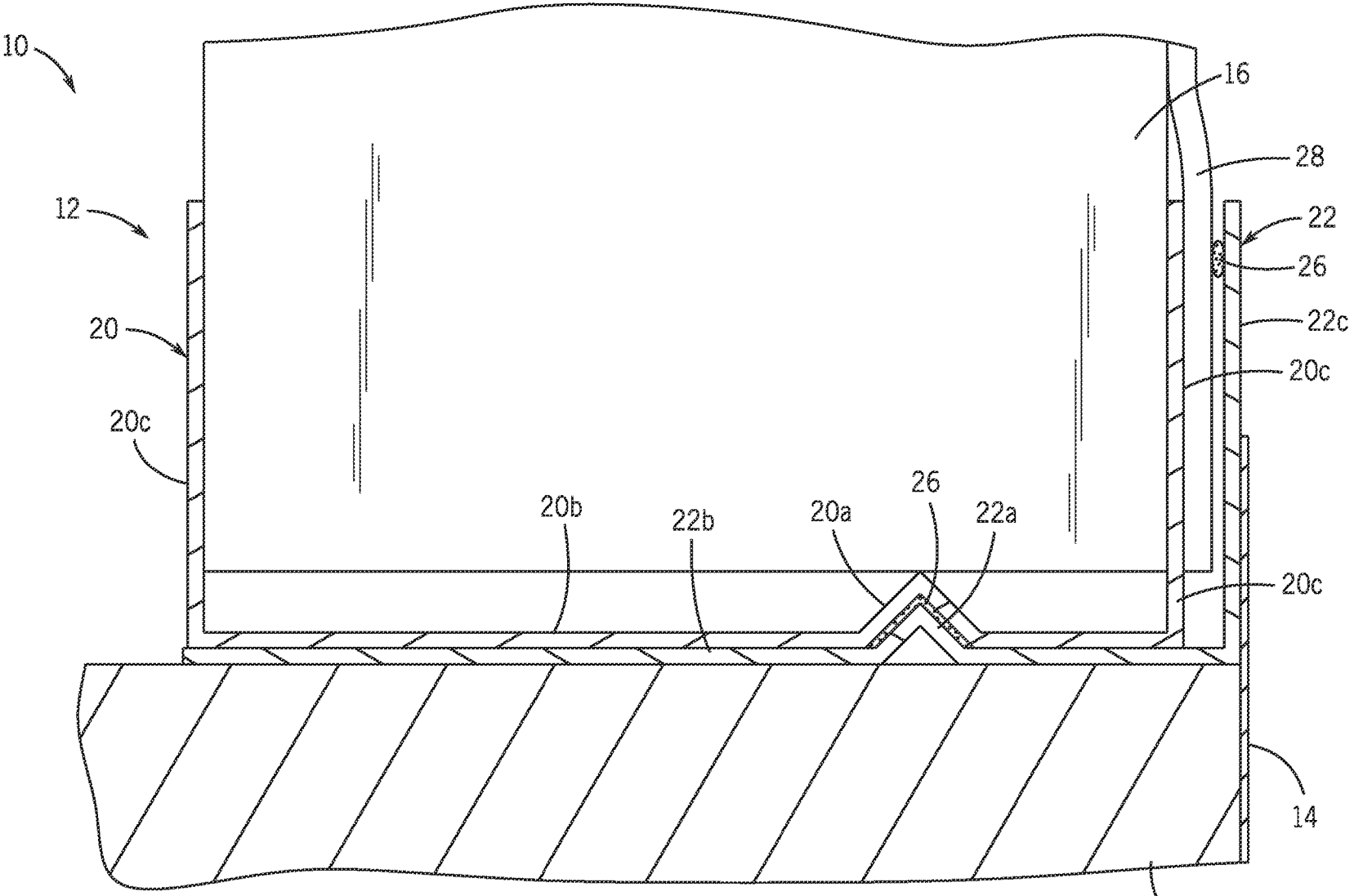
FIG. 7 is a cross-sectional detail view of the embodiment of the present invention, taken on line 7-7 of FIG. 1.

In accordance with certain aspects of the present invention, the bottom track 20 may be installed or attached to the panel 16 as the panel 16 itself is being constructed. As shown in FIG. 7, the track upper walls 20*c* and track bottom wall 20*b* envelope a bottom edge of the panel 16, with the bottom edge engaging/contacting the track ridge 20*a*. The purpose of the track ridge 20*a* (and also the receiver ridge 22*a*) is to prevent water from gaining access from underneath the track 20 and receiver 22 via negative pressure. Also, the ridges 20*a*, 22*a* are there to index the panel 16 and lock in its location in plane based on the architectural drawings.

Figure 5:
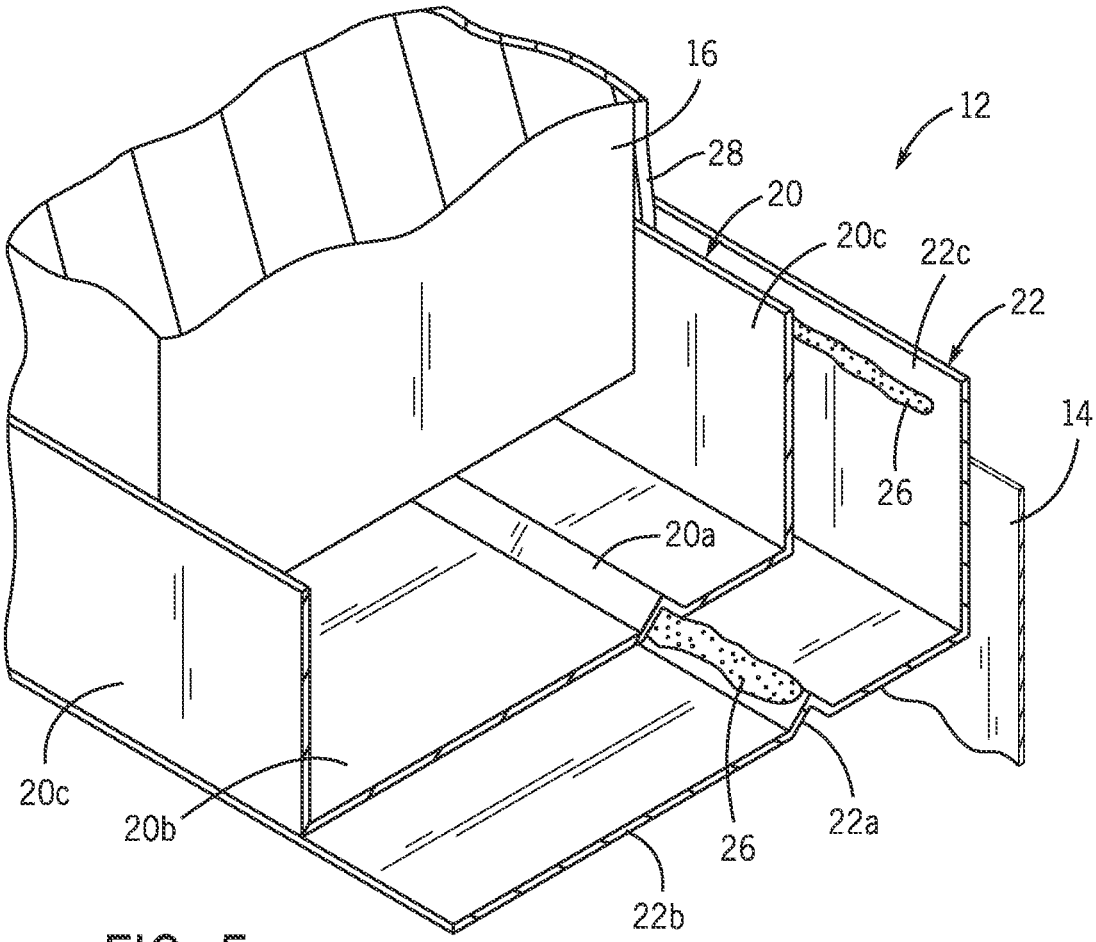
FIG. 5 is a cutaway perspective view of the embodiment of the present invention, showing the interior of a bottom assembly.

As further shown in FIG. 7, the receiver 22 is installed at a bottom of the opening of the building 18. An outer portion of the receiver 22 may be treated with the air barrier 14 that seals any gaps between the building 18 and the receiver 22 to ensure water tightness. As shown in FIGS. 5 and 7, the bottom track 20 and receiver 22 have complementary cross-sectional profiles so that the bottom track 20 rests flat on the receiver 22 when the panel 16 with the bottom track 20 is installed in the opening with the receiver 22. When this installation occurs, the respective ridges 20*a*, 22*a* align and the receiver ridge 22*a* nests within the track ridge 20*a*, with sealant 26 being provided therebetween. Thus, a watertight seal between the bottom track 20 and receiver 22 is formed. As further shown in FIGS. 5 and 7, a lower portion of the sheathing 28, which is attached to an outer side of the panel 16 and overlays at least a portion of one of the track upper walls 20*c*, extends into a gap defined by one of the track upper walls 20*c* and the receiver upper wall 22*c* when the bottom track 20 is installed with the receiver 22. Sealant 26 may be provided between the sheathing 28 and the receiver upper wall 22*c* to ensure no moisture can penetrate the previously described gap.

Figure 6:
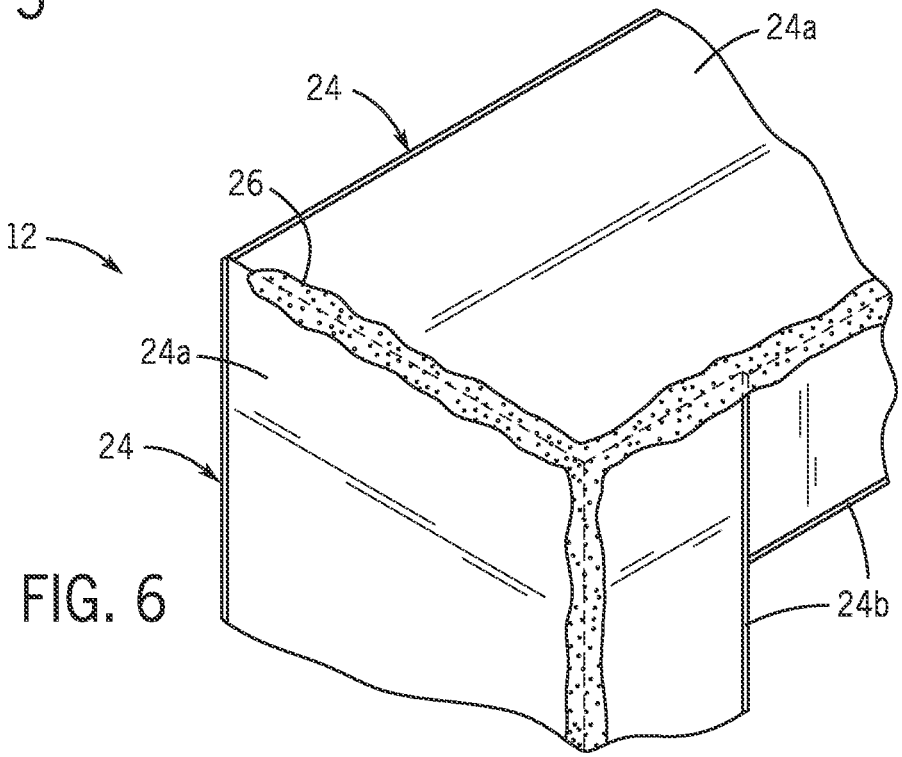
FIG. 6 is a detail perspective view of the embodiment of the present invention, showing the interior of a top assembly.

In accordance with other aspects of the present invention, and referring to FIGS. 1, 4 and 6, the angle members 24 are used to form a header and jamb for the panels 16. In certain embodiments, an angle member 24 may be used in place of the bottom track 20 and receiver 22, as presently embodied, to serve as a bottom seal structure of the panel 16. However, for reasons outlined above, the bottom track 20 and receiver 22 have various functional benefits that make it superior to the use of an angle member 24. As shown in FIGS. 1 and 6, the angle members 24 are installed in the opening of the building 18 such that the second wall 24*b* extends from an edge of the opening into the opening, thus ensuring that when the panel 16 is installed, the second wall 24*b* prevents the panel 16 from falling through the opening. The vertically extending angle members 24 are typically installed at wherever termination of the panels 16 occur, which is generally (but not always) at a column. Referring to FIG. 6, as with the bottom portion of the framing assembly 12, sealant 26 may be used at joints to ensure a watertight seal between the angle members 24 and the building 18. Together, the angle members 24 with the bottom track 20 and receiver 22 result in an air and watertight assembly around the edges of panels 16 installed in buildings 18. The angle members, in particular, have a number of other potential uses, such as other metal framing including ceiling framing or anything that requires an L-shaped sheet metal for install.

While methods of making the present invention would be readily apparent to those with skill in the art from the foregoing disclosure, a method of making embodiments of the present invention may include the following. First, an exterior panel 16 is fabricated in accordance with typical CFMF procedures. Metallic-coated sheet steel may be roll-formed to create the bottom track 20, receiver 22, and angle members 24. The bottom track 20 is then permanently affixed to a bottom edge of the panel 16, and gypsum sheathing 28 may be attached to an outer wall of the panel 16.

Further, while methods of using the present invention would be readily apparent to those with skill in the art from the foregoing disclosure, a method of using embodiments of the present invention may include the following. First, the receiver 22 is installed (using, for example, a shot and pin method) at the base (such as a concrete slab) of an opening in a building 18. Angle members 24 are then installed on a ceiling/header of the opening and at any location where the panels 16 end, such as a concrete column. The receiver 22 and angle members 24 may both be treated with any number of appropriate air barrier systems being used on the building 18. The air barrier 14 bridges the frame assembly 12 of the present invention to the building 18. Next, a bead of sealant 26 is run along outside edges of the receiver 22 and angle members 24 as well as along the receiver ridge 22*a*. Next, the exterior panel 16, with the bottom track 20 defining a bottom edge thereof, is installed within the opening (with the user installing it from an interior of the building 18), with the bottom track 20 mating with the receiver 22 and other edges of the panel 16 engaging at least one of the angle members 24 (specifically, the second walls 24*b*). The panel may then be secured in the opening using various techniques. Prior to installing a subsequent panel 16, another bead of sealant 26 is applied to a leading edge of the panel 16 and behind the sheathing 28, as shown in FIG. 1. Next, an adjacent panel 16 is installed by sliding it snugly against the previously installed panel 16 and into the bead of sealant 26. This process may be continued until the opening of the building 18 is enclosed by the panels 16.

It should be understood, of course, that the foregoing relates to exemplary embodiments of the invention and that modifications may be made without departing from the spirit and scope of the invention as set forth in the following claims.

What is claimed is:

1. A framing assembly for installing a wall panel in an opening of a building, the framing assembly comprising:

a receiver having a receiver upper wall joined with a receiver bottom wall along a length of the receiver, and a receiver ridge defined in the receiver bottom wall, the receiver bottom wall configured to be installed along an outer edge of the opening of the building with the receiver upper wall protruding into the opening along the outer edge of the opening of the building and the receiver bottom wall disposed towards an interior of the building; and a bottom track having a first track upper wall joined with a track bottom wall along a length of the bottom track, the track bottom wall defining a track ridge, the bottom track configured to be attached to an edge of the wall panel, wherein the receiver is adapted to laterally receive the bottom track from the interior of the building into the opening along a transverse axis of the receiver, and the receiver ridge and the track ridge index with one another with the track received in the receiver.

2. The framing assembly of claim 1, wherein the track ridge is configured to contact the edge of the wall panel.

3. The framing assembly of claim 1, wherein the bottom track further comprises a second track upper wall joined with the track bottom wall opposite and spaced apart from the first track upper wall, the first and second track upper walls and the track bottom wall defining a channel that is configured to receive the edge of the wall panel.

4. The framing assembly of claim 3, wherein the receiver upper wall disposed the first track upper wall being spaced from the receiver upper wall such that a gap is defined therebetween when the track ridge is indexed with the receiver ridge.

5. The framing assembly of claim 1, wherein the receiver ridge and the track ridge each define a cross-sectional shape that is substantially V-shaped.

6. A framing system comprising:

a building defining an opening;

a wall panel; and a framing assembly comprising:

a receiver installed along an edge of the opening, the receiver including a receiver bottom wall that defines a receiver ridge extending along a length of the receiver, and an upper receiver wall protruding into the opening from the receiver bottom wall; and a bottom track attached to an edge of the wall panel and including a track bottom wall that defines a track ridge, the receiver adapted to laterally receive the bottom track along a transverse axis of the receiver, and the bottom track matingly engaging the receiver from an interior of the building, such that when the bottom track overlays the receiver, the receiver ridge and the track ridge are indexed with one another.

7. The framing system of claim 6, the framing assembly further comprising:

an angle member including a first wall installed along a second edge of the opening and a second wall protruding into the opening.

8. The framing system of claim 7, wherein the protruding of the receiver upper wall and the second wall of the angle member into the opening are oriented for preventing the wall panel from passing through the opening in a direction of installation.

9. The framing system of claim 6, wherein the receiver ridge and the track ridge have a sealant disposed therebetween to prevent air or moisture from passing between the receiver and the track bottom.

10. The framing system of claim 6, wherein a sheathing is installed on a first side of the wall panel and covers a portion of the bottom track.

11. The framing system of claim 6, further comprising:

an air or moisture barrier configured to seal a gap between the building and the receiver.

12. The framing system of claim 6, further comprising:

a seal interposed between an outer face of a track upper wall of the bottom track with an inner face of the upper receiver wall.

13. The framing system of claim 7, further comprising:

a seal between each of the receiver, the angle member and the building.

* * * * *